United States Patent [19]

Aschinger et al.

[11] Patent Number: 4,507,714

[45] Date of Patent: Mar. 26, 1985

[54] DISPLAY CASE ADAPTED FOR HIGH LEVEL INCANDESCENT ILLUMINATION

[75] Inventors: William T. Aschinger, Gahanna; Jack F. Pfeifer, Grove City; Dale E. Shumaker, Columbus, all of Ohio

[73] Assignee: The Columbus Show Case Company, Columbus, Ohio

[21] Appl. No.: 585,219

[22] Filed: Mar. 1, 1984

[51] Int. Cl.[3] ..... F25D 27/00

[52] U.S. Cl. ..... 362/126; 362/33; 362/97; 362/125; 362/128; 362/133; 362/294; 362/373

[58] Field of Search ..... 362/33, 97, 128, 133, 362/145, 294, 373, 125, 126

[56] References Cited

U.S. PATENT DOCUMENTS 2,355,731 8/1944 James ..... 362/125

2,534,637 12/1950 Sussin ..... 362/373

2,596,393 5/1952 Fitzgerald ..... 362/373

*Primary Examiner*—Donald P. Walsh

*Attorney, Agent, or Firm*—William S. Rambo; William Cates Rambo

[57] ABSTRACT

A pair of relatively high wattage tungsten-halogen lamps are mounted directly below a pair of spaced-apart apertures in a forward portion of a horizontal deck that separates the case into a display compartment and a utility cabinet. Forced air ventilation is provided in the utility area to cool the lamps. A ceiling mirror in the display compartment reflects the light onto the display deck. Front and rear windows disposed below and on opposite sides of the ceiling mirror lie outside of the light pathways to prevent glare. Side mirrors and a diagonal front mirror also reflect light onto the merchandise in the display area while avoiding the windows.

9 Claims, 3 Drawing Figures

DISPLAY CASE ADAPTED FOR HIGH LEVEL INCANDESCENT ILLUMINATION

BACKGROUND OF THE INVENTION

The present invention relates to free-standing commercial display cases and more particularly to those provided with indirect lighting and lamp ventilating equipment.

It is well known that relatively high level, incandescent illumination hightens the attractiveness of most goods and packaging, especially jewelry. Merchants have made use of this visual effect with overhead spotlights, track lighting and the like to display their wares. Incandescent bulbs are preferred over fluorescent tubes because the light emitted from a glowing filament spans the entire visible spectrum, whereas the excitation of gases contained in and particles coating the inner surface of a luminescent source creates light having a considerably more limited range of wavelenqths. Many types of merchandise, especially jewelry and crystal, have a prismatic effect on light. This aesthetically pleasing effect is enhanced when the available light can be separated into the entire spectrum, as in the case of incandescent illumination, rather than into the much smaller fraction of colors attendant to luminescent sources. In addition, high wattage incandescent lamps are preferred over relatively low wattage sources of like kind because the former impart greater brilliance, depth and contrast to the objects they illuminate than the latter.

Heretofore, however, fluorescent or relatively low wattage incandescent lighting has been employed in merchandise showcases because asubstantial amount of heat and, of course, light are generated by relatively high-powered incandescent lamps. Both of these elements can cause damage or discomfort to the shopper or merchant who comes too close to the lamp or who receives light directly in the eyes. In addition, the heat from the lamp can damage the case or its contents if it becomes trapped inside.

The closest prior art known to the inventors is U.S. Pat. Re. 22,735 issued Mar. 26, 1946 to James. The James reissue patent discloses a fluorescent lamp mounted in a lower rear portion of a case below the display area floor. A portion of the light emitted from the lamp reflects off of a first mirror on a lower front wall, passes through an opening in the display area floor and reflects off of a second mirror at the top of the display area. While the James reference teaches the use of mirrors and an apertured deck to prevent light from striking the viewer's eyes, the display case disclosed therein cannot provide large amounts of light to the goods. First, a high powered bulb could not be used because there is no ventilation system for such a lamp. Secondly, the hidden light source, translucent floor and dual reflectors diffuse the light unduly.

In contrast, the present invention includes a relatively powerful incandescent lamp, a ventilation system to remove heat generated by the lamp, and a plurality of relatively short light pathways between the source and the goods, as hereinafter described in some detail.

SUMMARY AND OBJECTS OF THE INVENTION

A display case for which the present invention is intended is formed with a plurality of enclosure-forming panels, including a generally horizontally disposed deck that separates the case into an upper display compartment and a lower utility cabinet. The invention itself is an improvement comprising: a front merchandise-viewing window mounted on the display compartment, a rear merchandise-viewing window mounted on the display compartment in spaced relation to the front window; a light source mounted in a forward portion of the utility cabinet; an aperture disposed in a forward portion of the deck in generally vertical alignment with the light source, a ceiling mirror mounted in the display compartment to receive light in a substantially straight line from the light source; and a vent structure disposed in communication with the light source. The aperture, windows and light source are sized and positioned relative to one another to substantially hide the light source from view through the windows.

A primary object of the present invention is to substantially increase the amount of illumination within a display case. Another object is to reduce the possibility of relatively high-powered light striking the eyes of the viewer. A further object is to prevent the heat generated by a high level light source from damaging the goods housed within a showcase or injuring or discomforting shoppers or attendants. These and other objects and advantages of the present invention may be more clearly and readily understood in view of the following drawings and detailed description.

DETAILED DESCRIPTION OF THE PREFERRED EMBODIMENT

Figure 1:
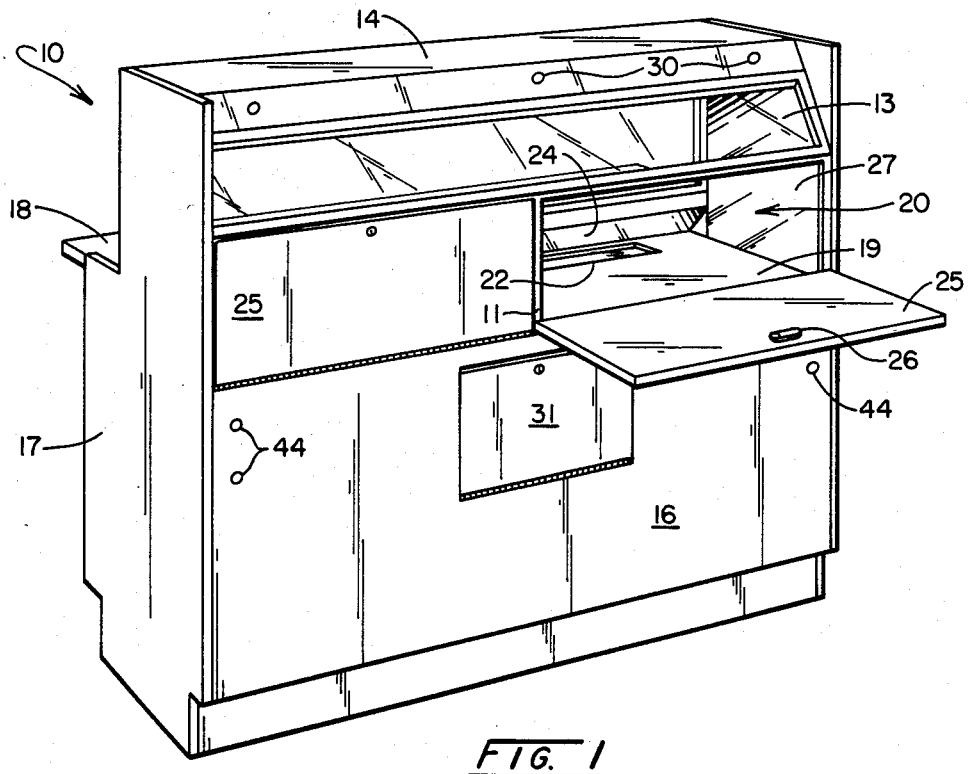
FIG. 1 is a rear perspective view of an illuminated display case according to the present invention, particularly illustrating components of an upper display compartment on the attendant's side of the case.
Figure 2:
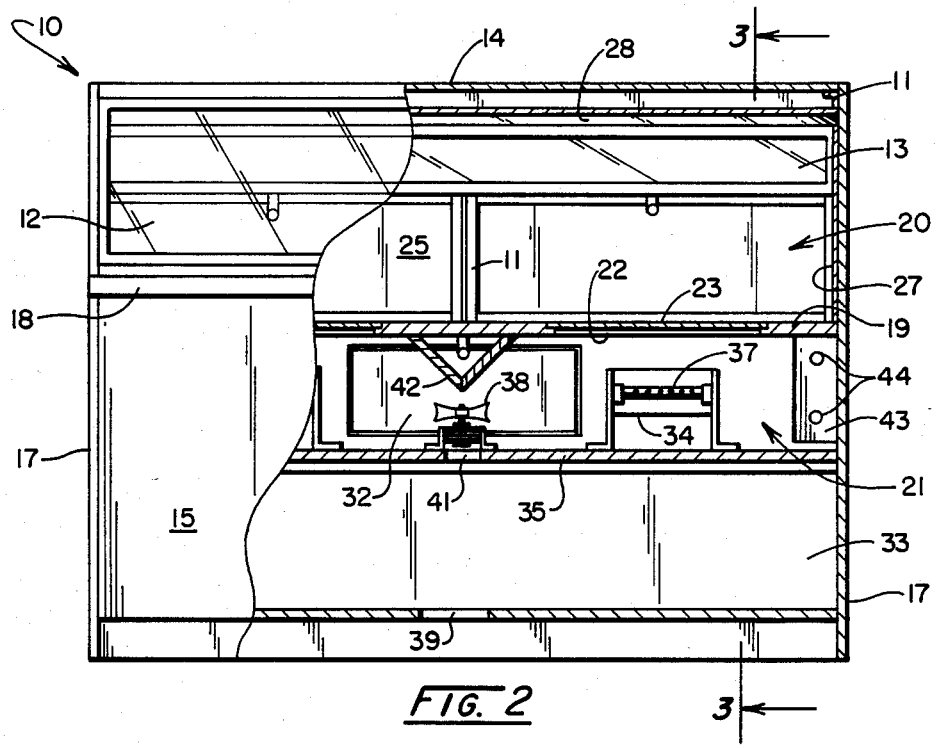
FIG. 2 is a front elevational view of the display case illustrated in FIG. 1, with portions of the front panels broken away to reveal the lighting and ventilation systems housed in a lower utility cabinet.
Figure 3:
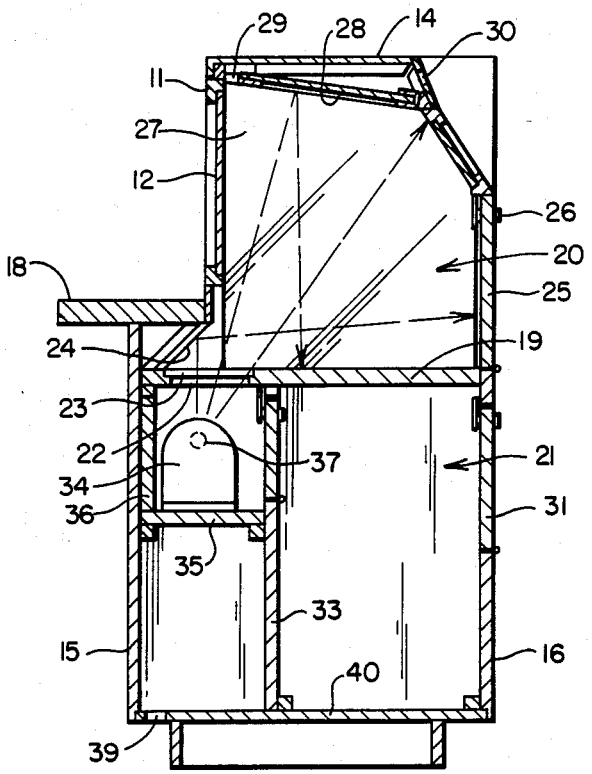
FIG. 3 is an enlarged vertical sectional view of said display case particularly illustrating the relative locations of the components that illuminate the merchandise deck and that prevent light from directly striking the windows of the display compartment.

As indicated in FIGS. 1–3, an illuminated display case, generally designated 10, according to the present invention is particularly well suited for housing jewelry and other valuable merchandise. Accordingly, it is constructed, advantageously, with a relatively sturdy, conventional framework 11 and with a plurality of substantially tamperproof, enclosure-forming panels. Said panels may include impact resistant, front and rear window panels 12 and 13, respectively, a steel top cover 14, and a generally conventional set of laminated or otherwise reinforced front, rear and end walls 15, 16, and 17, respectively. Preferably, the front window 12 is inset relative to the front wall 15, and a generally horizontally disposed customer shelf or ledge 18 extends therebetween and overhangs said front wall.

A generally horizontally disposed deck 19 is mounted in the case 10 and separates it into an upper display compartment 20 and a lower utility chamber 21. The deck or floor 19 is provided with a pair of spaced apart, generally rectangular light passageways or apertures 22 disposed end-to-end in a relatively forward portion of the deck. Transparent covers or lenses 23 are set into the apertures and are substantially flush with the upper surface of the deck.

As indicated in FIGS. 1 and 3, a relatively narrow front mirror 24 extends longitudinally from one end of the display compartment to the other in front of the apertures 22. The front mirror 24 is inclined over forward portions of the apertures 22 at an angle of approximately 45°. It is mounted diagonally between the leading edge of the deck adjacent to the front wall 15 and a relatively inset end of the customer shelf 18.

Access to the deck and the upper display compartment 20 is provided by a pair of panels 25 hingedly mounted on the rear wall 16 or attendant's side of the case immediately below the rear window 13. Key-actuated, rotatable tabs 26 or other suitable locking mechanisms secure the panels 25 to a portion of the framework 11 below the rear window.

Substantially vertically disposed side mirrors 27 are preferably secured to the end walls 17 of the case at opposite ends of the display compartment.

A ceiling mirror 28 is mounted in an upper portion of the display compartment in spaced relation to the top cover 14 and extends longitudally between the opposing side mirrors 27. As indicated in FIG. 3, a front edge of the ceiling or top mirror 28 is secured to a portion of the framework 11 adjacent to an upper edge of the front window 12, and the mirror is inclined downwardly to a rear member of the framework disposed above the rear window 13. The incline angle between the top mirror 28 and a horizontal portion of the top cover 14 is preferably fixed within the range of 6°–12°. Three spaced apart, internal exhaust vents or ports 29 are formed in a portion of the framework 11 supporting the front edge of the top mirror. Three spaced apart, external exhaust vents or ports 30 are formed in a downturned, rear portion of the top cover.

The utility cabinet or area 21 below the deck 19 is preferably divided into a number of chambers, in one of which lighting and ventilation equipment is mounted, as hereinafter described, and in another of which a storage safe (not shown) may be installed. Access to the various chambers of the utility area 21 is provided by a pair of doors 31 and 32 hingedly mounted, respectively, on the rear wall 16 and on an interior vertical partition wall 33 (FIG. 3). Like the display compartment doors 25, the utility cabinet doors 31 and 32 are provided with key-actuated locks. A pair of spaced apart lamp fixtures 34 are mounted in the utility cabinet 21 on an equipment shelf 35 extended between the front wall 15 and interior partition wall 32. Conventional electrical wiring and switches (not shown) provide current to the lamps from a conventional 60 Hz., 110–120 volt outlet (not shown). Each lamp 34 is disposed substantially directly below one of the apertures 22 and, as indicated in FIG. 3, is tilted towards the upper rear of the showcase. A layer of high temperature insulation 36 preferably comprising foil-covered, resin-impregnated fibrous material, is secured to the inner surface of the front wall 15 adjacent to the lamps.

A 250 watt tungsten-halogen bulb 37 or other relatively high-powered incandescent light source is mounted in each of the fixtures 34. Once installed, each bulb 37 is generally vertically aligned with and spaced below one of the apertures 22.

As illustrated in FIG. 2 an electrically powered fan 38 is mounted on the equipment shelf 35 between the lamps 34. Conventional wiring and switches (not shown) provide electricity to the fan from the same source employed by the lamps 34. An external intake vent or port 39 is formed in a front, overhanging portion of a subfloor 40 at the base of the showcase. An internal intake vent 41 is formed in the equipment shelf substantially directly below the fan 38. A generally V-shaped divider 42 is secured at its open end to the undersurface of the merchandise supporting deck 19, between the apertures 22 and the apex of the divider 42 is disposed above the fan blades. An exhaust duct 43 is provided between the interior vertical partition wall 33 and each of the end walls 17 of the case. Each duct extends rearwardly from the chamber in which the lamps 34 and the fan 38 are housed to the rear wall 16 of the showcase. A pair of external exhaust ports 44 are provided in the rear wall for each exhaust duct.

The light emitted from the bulbs does not strike the front or rear windows until it reflects off the merchandise housed in the display area. Glare does not reach the viewer either directly from the bulbs or indirectly from the front, side or ceiling mirrors due to the size and relative positions of the bulbs, apertures, mirrors and windows. As indicated in FIG. 3, the bulbs 37 and apertures 22 are positioned near the front wall 15, and the front window 12 is inset from said front wall so that the customer shelf 18 prevents light from reaching the front window. This offset arrangement also affects the front mirror 24, allowing it to be positioned diagonally between the apertures and shelf. As a result, light striking the front mirror is reflected at a relatively low angle and strikes the rear of the display compartment well below the rear window 13. Preferably, a display surface (not shown) that is stepped or inclined gradually from the front to the rear of the display compartment rests upon the deck 19 and allows merchandise positioned rearwardly thereon, to be illuminated by the front mirror 24, rather than being shadowed by more forwardly positioned goods.

FIG. 3 also shows that the relative sizes and positions of the bulbs 37, apertures 23 and rear window 13 prevent light from reaching the rear window on a direct line from the bulbs. Instead, upwardly projecting light rays strike the ceiling mirror 28 and reflect downwardly onto the deck 19. As previously indicated, the front window 12 is slightly inset relative to the lamps 34. The ceiling mirror, however, is inclined downwardly a few degrees from front to rear so that the light reflecting off of the mirror reaches substantially all of the deck surface extending rearwardly from the apertures.

The side mirrors 27 at opposite ends of the display compartment receive upwardly projecting light from the bulbs 37, downwardly projecting light from the ceiling mirror 28 and generally horizontally projecting light from the front mirror 24. Light from the bulbs is reflected by the side mirrors onto the ceiling mirror and then downwardly onto the deck. Light from the front mirror is reflected off of the side mirrors at a low angle towards the rear of the case. Some of the light reflecting downwardly from the ceiling mirror strikes the side mirrors and is then reflected onto the deck. Thus, the display compartment 20, particularly the deck 19, is bathed in light reflecting off of the aforesaid mirrors. In addition, the relative sizes and positions of the mirrors, bulbs, apertures and windows keep the light substantially within the compartment, thereby limiting the glare on the front and rear windows.

The number of light bulbs, lamp fixtures and apertures to be employed is determined by the wattage of the bulb and by the size of the showcase. In the present embodiment, two 250 watt bulbs and accompanying lamps and apertures are positioned with their centerlines thirty inches apart. Each bulb illuminates approximately 690 square inches of the display deck and generates approximately 5,000 lumens of light. Such an arrangement is particularly well suited for display decks that are approximately 40 to 75 inches wide and twenty to thirty-six inches deep. In such a display case, each light source will operate, preferably, at no less than 100 watts, which generates approximately 1800 lumens of light. In showcases provided with display decks that are more than 80 inches wide, three sets of 250 watt bulbs and accompanying lamps and apertures are preferably employed with their centerlines spaced thirty inches apart.

The ventilation system is, like the showcase itself, divided into two parts. The upper portion of the ventilation system is passive, as it relies upon convection currents and a system of vents or ports to control the air temperature within the display compartment. While the transparent covers or lenses 23 prevent a substantial amount of heat generated by the bulbs 37 from reaching the display compartment, some of the radiant energy generated by the incandescent bulbs passes through the lenses to heat the display compartment. The upper interior exhaust ports 29 draw the relatively warmer air out of the display compartment into the space between the ceiling mirror 28 and the top cover 14. Advantageously, the inclined ceiling mirror assists in moving relatively warmer air towards the interior vents, as said vents are located adjacent to the relatively elevated forward edge of the mirror. Once inside the space between the cover and mirror, the warmer air leaves the case through the upper exterior exhaust ports 30. These exterior exhaust ports 30 are preferably provided with a thick screen or security plate (not shown). Relatively cooler ambient air is drawn into the display compartment and the hotter air flows out of the exhaust vents when the display compartment doors 25 are opened. In addition, a more gradual circulation of air is provided when the rear doors are closed, because airtight seals are not provided between the framework 11 and said door.

In contrast to the passive, convection ventilation in the display compartment, air flow in the utility area 21 is assisted by the electrically powered fan 38. Relatively cooler ambient air is drawn into the utility area through the lower external intake vent 39 and upwardly through the internal intake vent 41. The cooler air is then forced towards the lamps 34 in laterally opposite directions by the fan 38 and the divider 42. The air then absorbs some of the heat generated by the incandescent bulbs, travels rearwardly through the exhaust ducts 43 at opposite ends of the utility area, and escapes through the external exhaust ports 44. In addition to the temperature control provided by the forced air ventilation system, the customer is shielded from the heat generated by the lamps by the layer of insulation 36 (FIG. 3) disposed between the front wall 15 and the lamps.

Thus, the present showcase illuminates the merchandise contained within the display compartment to a substantially greater degree than heretofore possible through a unique combination and arrangement of components. In the first instance, an optical system is provided that directs the light onto the merchandise before it reaches the viewers.

Secondly, a ventilation system is provided that cools the light sources and display area, thereby saving the goods and showcase components from heat damage and preventing injury and discomfort to the viewers.

Although a single preferred embodiment of the present invention has been illustrated and described in some detail, the present disclosure is not intended to unduly limit or restrict either the invention or the scope of the following claims.

We claim:

1. In an illuminated display case having a plurality of enclosure-forming panels including a generally horizontally disposed deck separating said case into an upper display compartment and a lower utility cabinet, that improvement which comprises:

(a) a front merchandise-viewing window mounted on the display compartment;

(b) a rear merchandise-viewing window mounted on the display compartment in spaced relation to the front window;

(c) a light source mounted in a forward portion of the utility cabinet;

(d) means defining an aperture disposed in a forward portion of the deck in generally vertical alignment with the light source, and means defining an aperture, said front and rear windows and said light source being sized and positioned relative to one another to substantially hide said light source from view through said windows;

(e) a ceiling mirror mounted in the display compartment to receive light in a substantially straight line from the light source; and (f) ventilation means disposed in communication with the light source.

2. An illuminated display case according to claim 1, wherein said light source is an incandescent bulb of at least 100 watts.

3. An illuminated display case according to claim 1, wherein the ventilation means includes at least one exhaust duct and at least one exhaust port for channeling heated air out of the utility cabinet.

4. An illuminated display case according to claim 1, wherein at least two light sources are mounted in a forward portion of the utility cabinet and means defining at least two apertures are disposed in a forward portion of the deck in generally vertical alignment with the light source, said light sources, said means defining at least two apertures and said front and rear windows being sized and positioned relative to one another to substantially hide said light sources from view through said windows.

5. An illuminated display case according to claim 1, wherein a generally vertically disposed side mirror is mounted at each end of the display compartment.

6. An illuminated display case according to claim 1, wherein a front mirror is mounted in the display compartment at an acute angle over a forward portion of the means defining an aperture to reflect light rearwardly and below the rear window of said display compartment.

7. An illuminated display case according to claim 1, wherein the front window is mounted on the display compartment in generally inset relation to the front edge of the deck.

8. An illuminated display case according to claim 1, wherein an opaque top cover defines substantially the entire horizontal top surface of the display compartment.

9. An illuminated display case according to claim 8, wherein at least one passageway is provided between the top cover and the ceiling mirror and at least one port is provided in said top cover for the movement of air out of the display compartment.

* * * * *

UNITED STATES PATENT OFFICE

CERTIFICATE OF CORRECTION

PATENT NO. : 4,507,714

DATED : Mar. 26, 1985

INVENTOR(S) : William T. Aschinger, Jack F. Pfeifer, and Dale E. Shumaker.

It is certified that error appears in the above-identified patent and that said Letters Patent are hereby corrected as shown below:

Col. 6, Claim 1, line 21 ,before "means", delete "and" and insert --said-- .

Signed and Sealed this

*Sixteenth* Day of *July 1985*

[SEAL]

*Attest:*

DONALD J. QUIGG

*Attesting Officer* *Acting Commissioner of Patents and Trademarks*